US005722811A

United States Patent [19]

Schum et al.

[11] Patent Number: 5,722,811

[45] Date of Patent: Mar. 3, 1998

[54] METHOD FOR SEPARATING A PREDETERMINED NUMBER OF SHEETS FROM A STACK OF SHEETS

[75] Inventors: Michael Schum, Cherry Hill, N.J.; Boris M. Akselrod, St. Petersburg, Russian Federation; Alexander N. Gerasimov, St. Petersburg, Russian Federation; Alexander L. Ljubomirsky, St. Petersburg, Russian Federation; Alex M. Piniaev, St. Petersburg, Russian Federation; Alexey N. Zakharov, St. Petersburg, Russian Federation; Simon S. Litvin, St. Petersburg, Russian Federation; Vladimir M. Gerasimov, St. Petersburg, Russian Federation; Michael Valdman, Boston, Mass.

[73] Assignee: Asomm, Inc., Cherry Hill, N.J.

[21] Appl. No.: 515,466

[22] Filed: Aug. 15, 1995

[30] Foreign Application Priority Data

Aug. 29, 1994 [RU] Russian Federation ..... 94032558

[51] Int. Cl.[6] ..... B65H 3/48

[52] U.S. Cl. ..... 414/796; 271/97; 414/795.5

[58] Field of Search ..... 271/97; 414/798.9, 414/795.5, 796

[56] References Cited

U.S. PATENT DOCUMENTS

| | | | |
|---|---|---|---|
| 3,635,463 | 1/1972 | Stobb | 271/6 |
| 4,204,667 | 5/1980 | Klenk | 271/3.1 |
| 4,222,556 | 9/1980 | Chapman et al. | 271/3.1 |
| 4,306,684 | 12/1981 | Peterson | 271/97 X |
| 4,635,921 | 1/1987 | Thomas | 414/795.5 X |
| 4,986,731 | 1/1991 | Shinomiya | 414/798.9 |
| 5,092,578 | 3/1992 | Bergmeier et al. | 271/97 |
| 5,096,370 | 3/1992 | Mohr | 414/795.5 X |
| 5,110,110 | 5/1992 | Wirz et al. | 271/97 X |

FOREIGN PATENT DOCUMENTS

| | | | |
|---|---|---|---|
| 4227814 | 2/1993 | Germany | 271/97 |
| 1-242334 | 9/1989 | Japan | 414/796 |
| 90/11240 | 10/1990 | WIPO | 271/97 |

*Primary Examiner*—Janice L. Krizek
*Attorney, Agent, or Firm*—Edward Dreyfus, Esq.

[57] ABSTRACT

A method of separation from a stack of sheets a block of predetermined number of sheets, the method including retaining the stack so that a portion of one edge of each consecutive foremost sheet is free to bend away from the stack, directing a plane of air flow sequentially on to the foremost surfaces of a predetermined number of foremost sheets to bend at least a portion of the free edge of each of the predetermined number of foremost sheets away from the stack, separating the bent predetermined number of foremost sheets into a block and removing the block from the remaining sheets in the stack. Preferably, the plane of the air flow intersects the plane of the sheets in the stack in the range of 5°–10°. The plane of the air flow can be directed to bend the free edge or just the corners of sheets in the block to be separated. In one example, the stack foremost end is inclined downward and the air flow is directed upward.

12 Claims, 3 Drawing Sheets

METHOD FOR SEPARATING A PREDETERMINED NUMBER OF SHEETS FROM A STACK OF SHEETS

BACKGROUND

Figure 1A:
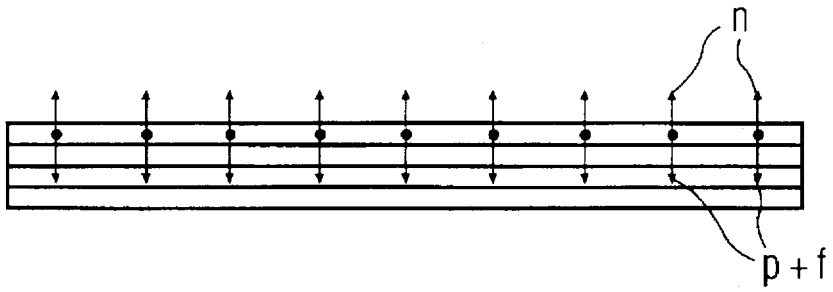

This invention relates to a method and apparatus for separating sheet material, such as paper, from a stack and can be used in automated document processing equipment such as high speed accumulators or counters.

One of the problems that must be solved in order to build a successful automated document processing line, such as an envelope inserter or a binder, is an ability to separate and combine all of the sheets of a document into a group. Prior to separation, these sheets could have gone through printing, laminating or other processes and were accumulated into a large contiguous stack. Thus, it is necessary to separate predetermined number of sheets stacked, one after another, to form a complete document.

The most simple methods are performed by the means of friction or vacuum rollers, where single sheets are separated from the stack and then directed one at a time into a receiving device or accumulator. The number of separated and then directed sheets for assembly into a group is counted by the use of mechanical, optical, or other sensors. See, for example, the sheet separation in the apparatus of U.S. Pat. No. 4,222,556, Chapman et al., 1980. This single sheet separation yields high quality control of the quantity of individual sheets but drastically reduces the performance of an automated line.

Better performance can be achieved if separated sheets, directed into a receiving device, are overlapped or displaced against each other, as disclosed in U.S. Pat. No. 3,635,463 to A. Stobb, 1972 or U.S. Pat. No. 4,204,667 to E. Klenk, 1980.

In the known apparatus of U.S. Pat. No. 3,635,463, sheets from the stack are separated by the use of a rotating brush that pushes sheets at their edges. Separated sheets are transported to a receiving device where the quantity is determined by the measurement of the thickness of the accumulated group by the use of a sensor.

In the apparatus of U.S. Pat. No. 4,204,667, the sheets from the stack are offset by the transport with a narrow gap, and the quantity of sheets is determined by measuring the thickness of accumulated groups in assembly station.

Greater performance could be achieved if the quantity of sheets that are separated from the stack is predetermined and directed to a receiving device so that a block of predetermined number of sheets is delivered to the receiving device. In the known apparatus of U.S. Pat. No. 4,986,731 to T. Shinomiya, 1991, a predetermined quantity of sheets is separated from the stack by the use of the following method. Initially, the block is offset or partially separated in reference to the stack by the use of the special lever. Next, the block is thrown to the moving transport and arrives at a receiving device. The quantity of pages is determined by the depth of an offset lever that moves along the edge of the stack. The apparatus of this U.S. Pat. No. 4,986,731 employs a method which is the closest to the method of the present invention. High performance could be achieved by realizing this known patent. However, such performance will require the use of an extremely high precision mechanical device which, under high production conditions, is very difficult to implement and does not solve the problem of controlling the precise quantity of pages in a separated block.

SUMMARY OF OBJECTS OF THE INVENTION

The technical objective of the present invention is to achieve a high performance and high reliability method of separation of a block of sheets from the stack which method also provides a simple technical solution to control the precise quantity of separated sheets placed in the block.

The essence of the present invention is characterized in that at the stage of partial separation of the block of sheets from the stack, the sheets in the stack are held such that at least one edge of the foremost sheet is free and can be slightly bent. An air flow is established onto the upper or foremost surface of each sheet to bend the respective sheet free edge away from the stack and move the plane of this air flow across the stack from the first to the last sheet of a separated block. The time of the plane air flow moving across the stack is determined to be sufficient to provide a slight bend and partial separation from the stack at the edge of every sheet separated in sequence from the stack.

DRAWINGS

Other and further objects and benefits provided by a system or method according to the present invention will become evident from the following detailed description of exemplary embodiments when taken in view of the appended drawings in which:

FIG. 1*a* is a diagrammatic side view representation of a stack of sheets.

Figure 1B:
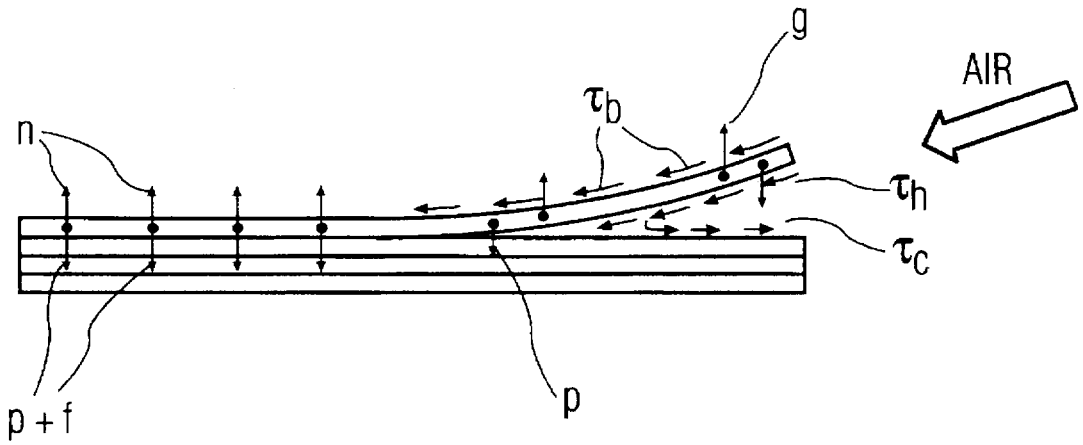

FIG. 1*b* is a diagrammatic representation of the stack of sheets of FIG. 1 a showing the principle of bending the sheets in the block according to the present invention by introducing an airflow.

Figure 2A:
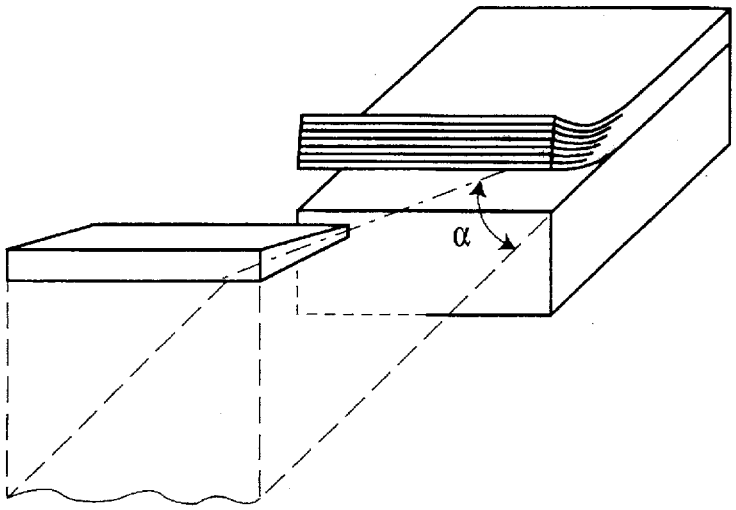

FIG. 2*a* is a diagrammatic perspective representation of the arrangement of FIG. 1*b* showing a number of sheets separated in a block by the principle shown in FIG. 1*b*.

Figure 2B:
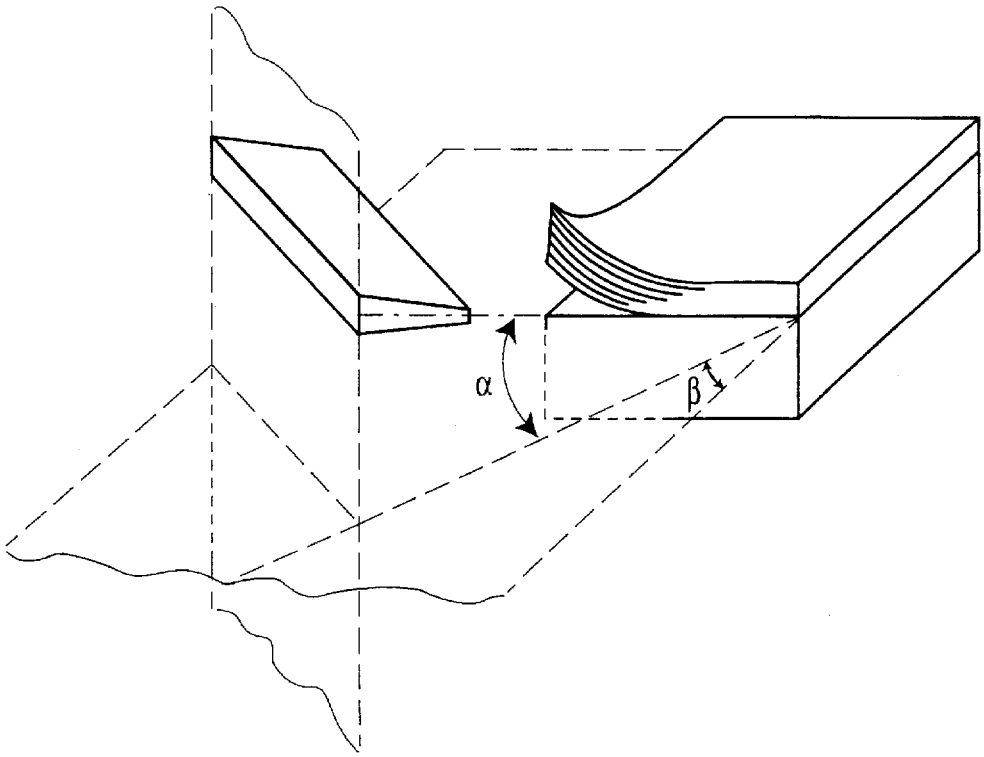

FIG. 2*b* is a view similar to FIG. 2*a* of an alternate embodiment in which the sheets are bent at their corners into the block.

Figure 3:
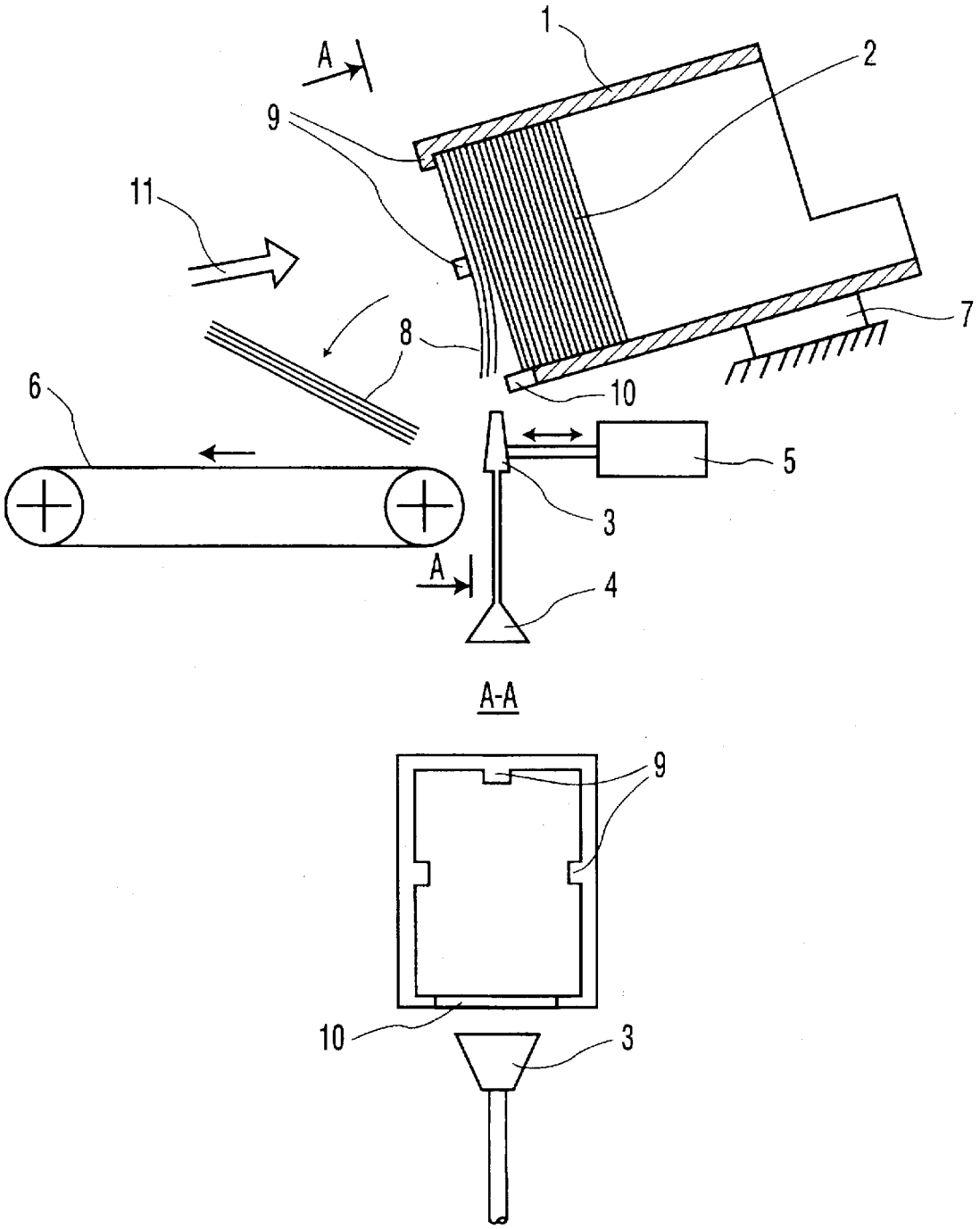

FIG. 3 is a schematic representation of an apparatus employing the principle of the present invention.

FIG. 1*a* and 1*b* show the physical principles occurring during the supply of the planar air flow to the edge of the stack according to the present invention. FIG. 1*a* shows the distribution of a mechanical load on the top or foremost sheet of paper in the stack without an airflow, where: p=distributed weight force of the sheet, f=distributed cohesion force with the following sheet, n=distributed reaction force.

Therefore: n=p+f.

Applying the stream of air flow to the foremost surface of the edge part of the stack in the general direction as shown in FIG. 1*b* develops on the external surface of the top sheet tangent forces $\tau_b$, that upon reaching a certain level will raise up the edge of the sheet. From that moment on in this part of the bent sheet the cohesion force f disappears. However, tangent $\tau_h$ and normal g stresses develop on the internal surface of the sheet, due to penetration of the air flow under the raised or bent sheet. Since the air flow breaks down under the sheet and gets distributed in the across direction, $\tau_b > \tau_h$. Simultaneously, the lower part of the air flow, interacting with an external surface of the following sheet due to the tangent stress $\tau_c$ retains this sheet against the stack.

Bending the edge of the top sheet and moving the plane of the air flow down across the stack reduces the stress $\tau_c$ and changes its direction to the opposite thus already developing the stress $\tau_b$ for the following sheet. Thus a process develops of bending up the second sheet analogous to the above shown top sheet. As a result, the edge of the following sheet is bent and separated. Thus, all of the bent sheets due to the growing stress g and disappearance of the force f are held in the bent condition.

Accordingly, unlike the prior known apparatus, the method according to the present invention applies originating forces that lead to sequential bending and separation of sheets from the stack. If, for any reason, two sheets begin to bend simultaneously, the stress $\tau_h$ provides the separation force for these sheets. Two sheets might tend to bend together due to accidental gluing or an electrostatic adhesiveness. The separation force was successfully confirmed in an experiment where two sheets were purposely attached to each other by a drop of glue.

According to the inventive method, the sheets should only bend and not fly apart. Therefore, it is necessary to apply a holding force to the sheets in the stack for instance by the use of holders in the middle of the stack or an auxiliary air flow against the mid-to-rear portion of the stack. See FIG. 3 as described below.

Bending a predetermined quantity of sheets from the stack is achieved by corresponding displacement of the front of the air flow across the stack from the first to the last sheet of a separated block of sheets. In addition, the fact that sheets are bent away from the stack in the consecutive order, one after another, creates a possibility to use a relatively simple, standard technical method such as photo sensors for additional control of the amount of separated sheets.

FIGS. 2 *a* and *b* display example arrangements for implementing the present method. FIG. 2*a* shows the arrangement shown in FIG. 1*b* when the front of the air flow is oriented in parallel to one of the edges of the stack. Alternately, the air flow plane can be directed at a corner of the stack (FIG. 2*b*)

Symbolization for FIGS. 2*a* and 2*b*:

α-angle between the plane of the air flow and the plane of the sheets in the stack;

β-angle between the front of the air flow and one of the side corner edges of the stack (see FIG. 2*b*);

Several tests were performed to verify the working ability of the present method. In confirming the present method technical result, it has been determined that the optimum range of the angle α is in within 5°–10° of the planes of the sheets.

In addition, in order to enhance the forces for bending sheets away from the stack, the following steps can be taken:

ionizing air flow that would allow the surface of the sheets to be charged with identical polarity which will repel each other and aid the separation forces;

humidifying air flow for removing static charges, accumulated during printing or other processes, that causes the sheets in stack to be attracted or adhere to each other;

provide modulation in the narrow range of intensity of the air flow which tends to "fluff up" the very edges of the sheets.

The block of predetermined separated sheets can be separated from the stack of remaining sheets by simply mechanically gripping this block or dropping the block on to a transporting mechanism and into a receiving device. In order to simplify this procedure, it is possible, just before the separation of the block of sheets from the stack, to increase the air flow intensity by several times which increased air flow will substantially raise up or move the separated block of sheets.

FIG. 3 represents an exemplary embodiment of an apparatus that implements the present method. The apparatus includes hopper 1, where the stack of paper sheets 2 is placed, and injector 3 which is attached to compressed air supply 4. A displacement mechanism 5 positions injector 3, conveyor transport 6 transfers the block and vibrator 7 vibrates hopper 1. Hopper 1 can be a rectangular box adjustable to the size of sheets. In order to provide automatic advancement of stack 2 after separation of the sheets of block 8, hopper 1 is installed at an incline and is supported on vibrator 7. Sheets in stack 2 are held by use of stoppers 9, placed at the sides of the output part of hopper 1. The lower edge of the foremost sheets are free and can be bent. A cutout 10 in hopper 1 provides access of the air flow to the lower and foremost edge of stack 2.

In operation, hopper 1 is loaded with stack 2. Displacement mechanism 5 positions injector 3 to direct air toward the foremost sheet of stack 2. Compressed air supplied by injector 3 bends the lower edge of each sheet as shown in FIG. 1*b*. Mechanism 5 displaces injector 3 along the edge of stack 2 to a predetermined distance along stack 2 to predetermine the quantity of sheets to bend and combine into the separated block 8. During this time, sheets are held by stoppers 9. For complete separation of block 8 from stack 2 intensity of air flow can be sharply increased by injector 3 to bow block 8 and release it from being retained by stoppers 9. The separated block 8 is then conveyed by transport 6 to a receiving device (not shown) for additional procedures.

To achieve a reliable holding of sheets in stack 2 during their bending, stoppers 9 should be relatively large, but, on the other hand, in order to push block 8 to transport 6 by the use of air flow, stoppers 9 should be, as small as possible. This contradiction is solved by creation of additional holding of sheets to stack 2 by use of additional air flow 11, which is supplied only at the time of first phase of separation of sheets from stack 2 and not when block 8 is to be removed from the stack. Thus stoppers 9 could be implemented either of small size or completely removed.

The application of the present invention is not limited to separation of paper sheets. This present invention can also be used for separation of relatively light and flexible metal sheets (foil), sheets of plastic, or film.

What is claimed:

1. A method of separating a block of sheets of a predetermined number of sheets from a stack of sheets, the method comprising:

retaining the stack so that at least a portion of one edge of each consecutive foremost sheet is free to bend away from the stack, directing a plane of air flow sequentially onto the foremost surfaces of a predetermined number of at least two foremost sheets to bend at least portions of the free edges of the predetermined number of foremost sheets sequentially away from the stack, separating the bent predetermined number of foremost sheets into a block, and removing the block from the remaining sheets in the stack.

2. Method according to claim 1, wherein the plane of the air flow intersects the plane of the sheets in the stack substantially in the range of 5°–10°.

3. Method according to claim 1, wherein the plane of the air flow is directed perpendicular to a free edge corner of the stack.

4. Method according to claim 1, wherein the direction of the air flow is oriented at a horizontal angle to said free edges of the stack in such a way that the air flow bends only the corners of said predetermined number of foremost sheets.

5. Method according to claim 1, wherein the air flow is ionized.

6. Method according to claim 1, wherein moisture is added to the air flow.

7. Method according to claim 1, wherein the air flow is modulated in intensity.

8. Method according to claim 1, wherein before complete separation of the block of sheets from the stack the intensity of the air flow is increased by an amount sufficient to completely move the block from the stack.

9. Method according to claim 1, wherein the block comprises a first foremost sheet and wherein during the directing step the block is held to the stack by a supplemental air flow directed in a plane generally perpendicular to the surface of the first foremost sheet of the block.

10. A method according to claim 1, wherein said stack is retained with the foremost end inclined downward and the air flow is directed upward.

11. A method according to claim 1, wherein said stack is retained with the foremost end extending upward.

12. Method according to claim 11 wherein said directing step includes causing the air flow to sequentially move across the bent edge of each sheet of said predetermined number of sheets in the direction along the remaining sheets of the stack.

* * * * *